US010886055B2

(12) United States Patent
Mizumura et al.

(10) Patent No.: US 10,886,055 B2
(45) Date of Patent: Jan. 5, 2021

(54) WOUND CORE AND MANUFACTURING METHOD THEREOF

(71) Applicant: NIPPON STEEL CORPORATION, Tokyo (JP)

(72) Inventors: Takahito Mizumura, Tokyo (JP); Masato Mizokami, Tokyo (JP); Masao Yabumoto, Tokyo (JP); Toshihiko Uemura, Tokyo (JP); Eisuke Minematsu, Tokyo (JP); Fumiaki Takahashi, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 0 days.

(21) Appl. No.: 16/474,823

(22) PCT Filed: Jan. 10, 2018

(86) PCT No.: PCT/JP2018/000364
§ 371 (c)(1),
(2) Date: Jun. 28, 2019

(87) PCT Pub. No.: WO2018/131613
PCT Pub. Date: Jul. 19, 2018

(65) Prior Publication Data

US 2020/0126709 A1 Apr. 23, 2020

(30) Foreign Application Priority Data

Jan. 10, 2017 (JP) ..... 2017-001829

(51) Int. Cl.
*H01F 27/245* (2006.01)
*H01F 1/147* (2006.01)
*H01F 41/02* (2006.01)

(52) U.S. Cl.
CPC ..... *H01F 27/2455* (2013.01); *H01F 1/147* (2013.01); *H01F 41/024* (2013.01)

(58) Field of Classification Search
CPC .... H01F 27/2455; H01F 41/024; H01F 1/147; H01F 27/25; H01F 41/02
(Continued)

(56) References Cited

U.S. PATENT DOCUMENTS

2011/0067786 A1 3/2011 Takashima et al.
2011/0212335 A1 9/2011 Takeda et al.
(Continued)

FOREIGN PATENT DOCUMENTS

CN 102227515 B 8/2013
CN 103415638 B 9/2015
(Continued)

OTHER PUBLICATIONS

Japanese Notice of Allowance for counterpart Japanese Application No. 2018-561392, dated Mar. 10, 2020, with English translation.
(Continued)

*Primary Examiner* — Tszfung J Chan
(74) *Attorney, Agent, or Firm* — Birch, Stewart, Kolasch & Birch, LLP

(57) ABSTRACT

A wound core is formed by laminating a plurality of bent bodies formed from a grain-oriented electrical steel sheet having a coating containing phosphorus formed on a surface, in a sheet thickness direction of the grain-oriented electrical steel sheet, in which the bent body is formed in a rectangular shape by having four flat portions and four corner portions adjacent to the flat portions, the corner portion has a bent region having a total bending angle of approximately 90° in a side view, the number of deformation twins present in the bent region in the side view is five or less per 1 mm of a length of a center line in the bent region in
(Continued)

the sheet thickness direction, and the amount of phosphorus eluted from the corner portion in a case of being boiled in water for 30 minutes is 6.0 mg or less per 1 $m^2$ of a surface area of the corner portion.

5 Claims, 8 Drawing Sheets

(58) Field of Classification Search
USPC ..... 336/200, 232, 234
See application file for complete search history.

(56) References Cited

U.S. PATENT DOCUMENTS

| | | | | |
|---|---|---|---|---|
| 2013/0309525 | A1 | 12/2013 | Fujikura et al. | |
| 2014/0251514 | A1* | 9/2014 | Watanabe | C22C 38/06 148/645 |
| 2015/0132547 | A1 | 5/2015 | Inoue et al. | |
| 2018/0002776 | A1 | 1/2018 | Kano et al. | |

FOREIGN PATENT DOCUMENTS

| | | | | | |
|---|---|---|---|---|---|
| EP | 0202339 | A1 | | 11/1986 | |
| JP | 62270723 | A | * | 11/1987 | |
| JP | 60-245205 | A | | 12/1995 | |
| JP | 10-32132 | A | | 2/1998 | |
| JP | 2009-52060 | A | | 3/2009 | |
| JP | 2009052060 | A | * | 3/2009 | C23C 22/20 |
| JP | 3081863 | U | | 11/2011 | |
| JP | 2011-243792 | A | | 12/2011 | |
| JP | 2011243792 | A | * | 12/2011 | |
| JP | 2012-161114 | A | | 8/2012 | |
| JP | 2012161114 | A | * | 8/2012 | |
| JP | 62-270723 | A | | 4/2013 | |
| JP | 2017-157806 | A | | 9/2017 | |
| KR | 10-2014-0119013 | A | | 9/2014 | |
| TW | 201641710 | A | | 12/2016 | |
| WO | WO 2013/058239 | A1 | | 4/2013 | |

OTHER PUBLICATIONS

"Methods of measurement of the magnetic properties of magnetic steel sheet and strip by means of a single sheet tester", JIS C 2556, 1996, total 170 pages.

"Test methods for electrical steel strip and sheet—Part 1: Methods of measurement of the magnetic properties of electrical steel strip and sheet by means of an Epstein frame", JIS C 2550-1, 2011, total 114 pages.

International Search Report for PCT/JP2018/000364 dated Mar. 27, 2018.

Notice of Allowance for TW 107100987 dated May 24, 2019.

Written Opinion of the International Searching Authority for PCT/JP2018/000364 (PCT/ISA/237) dated Mar. 27, 2018.

* cited by examiner

| AVERAGE CORE LENGTH (m) | CORE WEIGHT (kg) | VOLUME (KVA) |
|---|---|---|
| 0.704 | ABOUT 37 | 25 |

WOUND CORE AND MANUFACTURING METHOD THEREOF

TECHNICAL FIELD OF THE INVENTION

The present invention relates to a wound core and a manufacturing method thereof.

Priority is claimed on Japanese Patent Application No. 2017-001829, filed on Jan. 10, 2017, the content of which is incorporated herein by reference.

RELATED ART

Wound cores are widely used as magnetic cores for transformers, reactors, noise filters, and the like. A reduction in core loss caused by an iron core is hitherto one of the important tasks from the viewpoint of high efficiency and the like, and examinations have been conducted to reduce core loss from various viewpoints.

As one of manufacturing methods of a wound core, for example, a method of winding a steel sheet in a cylindrical shape, thereafter pressing corner portions to have a predetermined curvature, forming the steel sheet into a substantially rectangular shape, and thereafter performing annealing thereon for strain relieving and shape retention has been widely known. In a case of this manufacturing method, although the radii of curvature of the corner portions vary depending on the dimensions of the wound core, the radii of curvature thereof are as relatively large as about 4 mm or more such that the corner portions form gently curved surfaces.

As another manufacturing method of a wound core, a method of previously bending parts of electrical steel sheets which are to become corner portions of the wound core, and overlapping the bent electrical steel sheets, thereby laminating the electrical steel sheets into the wound core has been examined.

According to the manufacturing method, the pressing step is unnecessary. In addition, since the electrical steel sheet is bent, the shape is retained and shape retention by the annealing step is not an essential step. Therefore, there is an advantage that manufacturing is facilitated. In this manufacturing method, since the electrical steel sheet is bent, a bent region having a radius of curvature as relatively small as 3 mm or less is formed in the processed part.

As a wound core manufactured by a manufacturing method including bending, for example, Patent Document 1 discloses a structure of a wound core in which a plurality of magnetic steel sheets which are bent in an annular shape and have different lengths are formed so as to overlap in an outer circumferential direction, and facing end surfaces of the magnetic steel sheets are equally shifted by a predetermined dimension in a lamination direction thereof so as to form stepwise joint portions.

PRIOR ART DOCUMENT

Patent Document

[Patent Document 1] Japanese Utility Model (Registered) Publication No. 3081863

DISCLOSURE OF THE INVENTION

Problems to be Solved by the Invention

The present invention has been made taking the foregoing circumstances into consideration, and one aim of the present invention is to provide a wound core with suppressed core loss while having a bent region, and a manufacturing method thereof.

Means for Solving the Problem

The summary of the present invention is as follows.

(1) According to a first aspect of the present invention, a wound core is formed by laminating a plurality of bent bodies formed from a grain-oriented electrical steel sheet having a coating containing phosphorus formed on a surface, in a sheet thickness direction of the grain-oriented electrical steel sheet, in which the bent body is formed in a rectangular shape by having four flat portions and four corner portions adjacent to the flat portions, the corner portion has a bent region having a total bending angle of approximately 90° in a side view, the number of deformation twins present in the bent region in the side view is five or less per 1 mm of a length of a center line in the bent region in the sheet thickness direction, and the amount of phosphorus eluted from the corner portion in a case of being boiled in water for 30 minutes is 6.0 mg or less per 1 $m^2$ of a surface area of the corner portion.

(2) In the wound core according to (1), the grain-oriented electrical steel sheet may be a steel sheet in which local strain is applied to a surface of the steel sheet, or a steel sheet in which a groove is formed in a surface of the steel sheet.

(3) In the wound core according to (1), the Si content of the grain-oriented electrical steel sheet may be 2.0 to 5.0 mass %.

(4) In the wound core according to (1), the bent region may be a region enclosed by, in a side view of the bent body, when a point D and a point E on a line La representing an inner surface of the bent body and a point F and a point G on a line Lb representing an outer surface of the bent body are defined as follows, a line delimited by the point D and the point E on the line La representing the inner surface of the bent body, a line delimited by the point F and the point G on the line Lb representing the outer surface of the bent body, a straight line connecting the point D and the point G, and a straight line connecting the point E and the point F, <Definitions of Point D, Point E, Point F, and Point G> in the side view, a point at which a straight line AB connecting a center point A of a radius of curvature of a curved portion included in the line La representing the inner surface of the bent body to a point of intersection B between two imaginary lines Lb-elongation1 and Lb-elongation2 obtained by extending straight-line portions respectively adjacent to both sides a curved portion included in the line Lb representing the outer surface of the bent body intersects the line representing the inner surface of the bent body is referred to as an origin C, a point separated from the origin C by a distance m represented by Equation (1) in one direction along the line La representing the inner surface of the bent body is referred to as the point D, a point separated from the origin C by the distance m in the other direction along the line La representing the inner surface of the bent body is referred to as the point E, a point of intersection between a straight-line portion opposing the point D in the straight-line portion included in the line Lb representing the outer surface of the bent body and an imaginary line drawn perpendicularly to the straight-line portion opposing the point D through the point D is referred to as the point G, and a point of intersection between a straight-line portion opposing the point E in the straight-line portion included in the line Lb representing the outer surface of the bent body and an imaginary line drawn perpendicularly to the straight-line portion opposing the point E through the point E is referred to as the point F, $$m=r\times(\pi/4) \quad \text{Equation (1):}$$

(in Equation (1), m represents a distance from the origin C, and r represents a distance (radius of curvature) from the center point A to the origin C).

(5) According to a second aspect of the present invention, a manufacturing method of the wound core according to (1), includes: preparing a plurality of grain-oriented electrical steel sheets having a coating containing phosphorus on a surface; forming a plurality of bent bodies having a substantially rectangular shape in a side view by bending each corner portion forming region previously allocated to the plurality of grain-oriented electrical steel sheets in a state in which a temperature of the corner portion forming region is set to 150° C. or higher and 500° C. or lower; and laminating the plurality of bent bodies in a sheet thickness direction of the grain-oriented electrical steel sheet.

Effects of the Invention

According to the present invention, it is possible to provide the wound core with suppressed core loss while having the bent region, and the manufacturing method thereof.

EMBODIMENTS OF THE INVENTION (Cause of Core Loss and Mechanism of Suppression Thereof)

Figure 15:
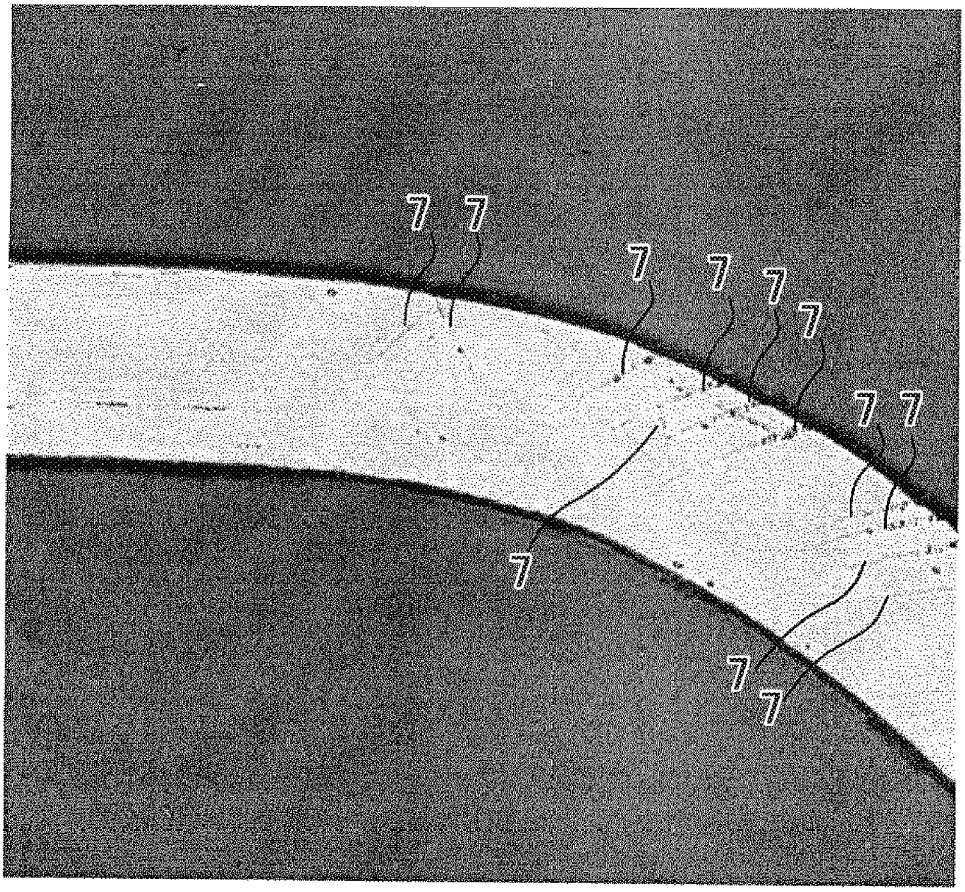
FIG. 15 is an enlarged photograph obtained by photographing a side surface of a bent region of a bent body included in a wound core in the related art, using an optical microscope.

The present inventors have obtained the findings that the core loss increases in a bent region formed when a grain-oriented electrical steel sheet is bent. FIG. 15 is an enlarged photograph obtained by photographing a side surface of a bent region of a bent body (hereinafter, simply referred to as a bent body) formed from grain-oriented electrical steel sheets constituting a wound core in the related art, using an optical microscope.

As shown in the example of FIG. 15, in the bent region of the bent body, deformation twins 7 extending inward from the surface of the steel sheet were observed. The deformation twins were confirmed by analytical evaluation using a scanning electron microscope and crystal orientation analysis software (EBSD). The grain-oriented electrical steel sheet is a steel sheet in which the orientation of grains in the steel sheet is highly integrated in a {110} <001> orientation (hereinafter, referred to as Goss orientation), but it was assumed that parts where deformation twins are generated have a different crystal orientation from the Goss orientation and become the cause of core loss. In addition, even if annealing is performed at about 750° C. after forming the wound core, the deformation twins generated during bending could not be eliminated.

The present inventors intensively conducted examinations from the viewpoint of suppressing the generation of deformation twins during bending, and as a result, it was obvious that deformation twins were suppressed by performing bending while heating a grain-oriented electrical steel sheet. Although there are some unclear points about the action of exhibiting such effects, it is presumed that processed parts that reached a high temperature facilitate movement of dislocations introduced by plastic deformation, which suppresses the generation of deformation twins and makes the generated deformation twins difficult to grow, so that the deformation twins do not extend in a streaky shape. As a result, it is presumed that the area fraction of the deformation twins in the entire steel sheet decreases, and the influence on the core loss decreases.

Furthermore, as the temperature of the grain-oriented electrical steel sheet during bending was increased, the generation of deformation twins had tended to be suppressed. However, there was a case where at a high temperature, even though the generation of deformation twins is suppressed, the core loss of the wound core is not suppressed. The cause thereof is unclear. However, it was presumed that the cause is the occurrence of cracking in the coating of the bent region due to processing at a high temperature and the occurrence of sticking between the base steel sheets exposed to the bent region.

Based on the findings, the present inventors found that both the generation of deformation twins and cracking of a coating are suppressed by adjusting the temperature of the grain-oriented electrical steel sheet to 150° C. to 500° C. during bending, and completed a wound core of the present invention with suppressed core loss while having a bent region.

Hereinafter, the wound core according to the present invention made based on the above findings, and a manufacturing method thereof will be described in detail in order.

The terms such as "parallel", "perpendicular", and "same", various such as lengths and angles, and the like that specify shapes, geometrical conditions, and degrees, which are used in this specification, are construed as including ranges in which the same functions can be expected. In addition, in the present invention, approximately 90° permits an error of ±3°, and means a range of 87° to 93°.

First Embodiment

Figure 1:
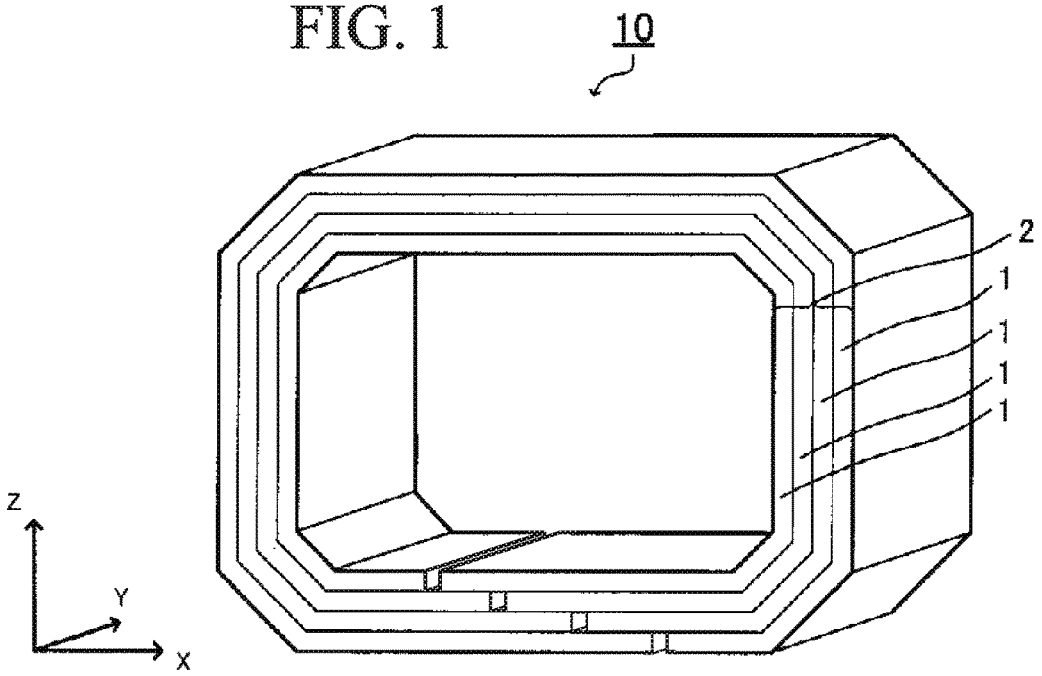
FIG. 1 is a perspective view of a wound core according to a first embodiment of the present invention.
Figure 2:
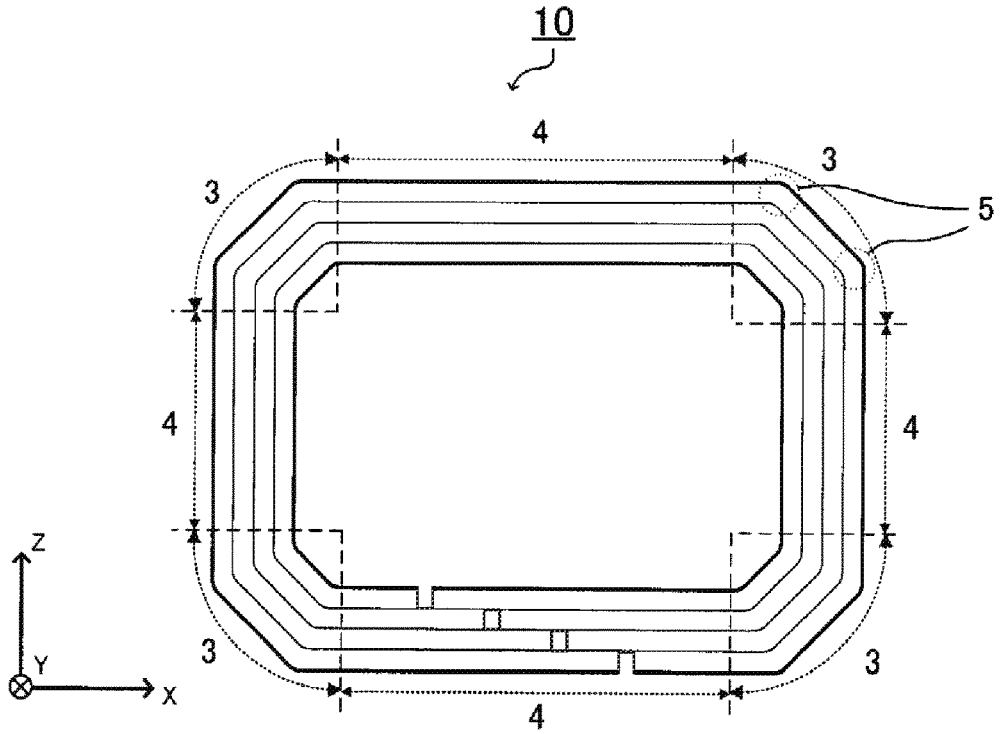
FIG. 2 is a side view of the wound core according to the embodiment.

FIG. 1 is a perspective view schematically showing a wound core 10 according to a first embodiment of the present invention. FIG. 2 is a side view of the wound core 10 according to the embodiment.

In the present application, "in a side view" refers to viewing in a width direction (Y axis direction in FIG. 1) of long grain-oriented electrical steel sheets constituting a wound core, and a side view is a view (a view in the Y axis direction in FIG. 1) showing a shape viewed in a side view. In addition, a sheet thickness direction is the sheet thickness direction of the grain-oriented electrical steel sheet, and means a direction perpendicular to the circumferential surface of the wound core in a state of being formed in a rectangular wound core.

The wound core 10 according to this embodiment is configured by laminating a plurality of bent bodies 1 formed from grain-oriented electrical steel sheet, in which a coating containing phosphorus is formed on the surface, in the sheet thickness direction thereof. That is, as shown in FIGS. 1 and 2, the wound core 10 has a substantially rectangular laminated structure of the plurality of bent bodies 1. The wound core 10 may be used as it is as a wound core. However, as necessary, the wound core may be fixed using a known binding band or a fastening tool.

As shown in FIGS. 1 and 2, each of the bent bodies 1 is formed in a rectangular shape by alternately connecting four flat portions 4 and four corner portions 3 along a circumferential direction. The angle between the two flat portions 4 adjacent to each corner portion 3 is approximately 90°.

As shown in FIG. 2, in the wound core 10 according to this embodiment, each of the corner portions of the bent body 1 has two bent regions 5 with a total bending angle of approximately 90° in a side view. The bent region 5 is a region having a shape bent in a curved shape in a side view of the bent body 1, and a more specific definition thereof will be described later.

Figure 3:
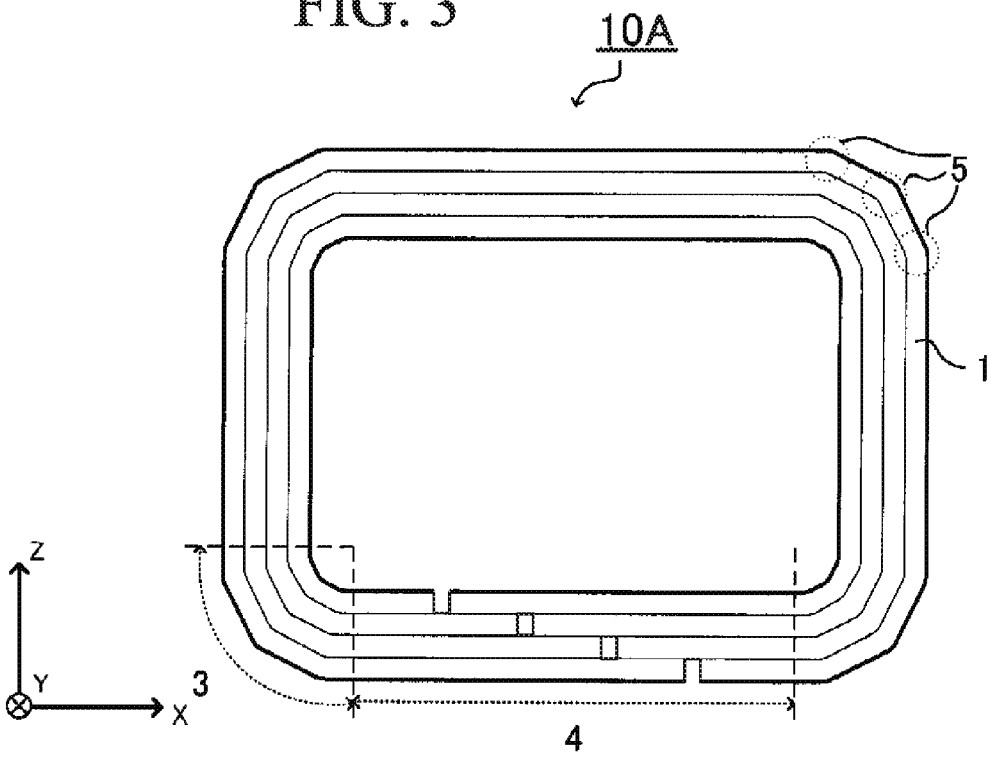
FIG. 3 is a side view showing a first modification example of the wound core.
Figure 4:
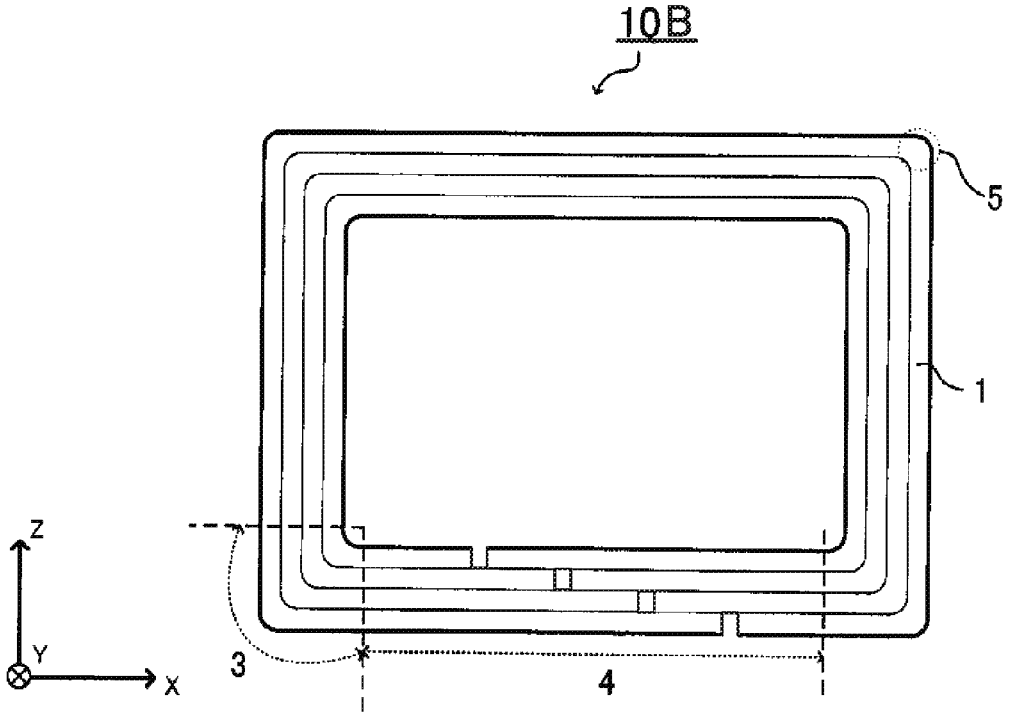
FIG. 4 is a side view showing a second modification example of the wound core.

Each of the corner portions 3 of the bent body 1 may have three bent regions 5 as in a wound core 10A according to a first modification example shown in FIG. 3, or may have one bent region 5 as in a wound core 10B according to a second modification example shown in FIG. 4. That is, each of the corner portions 3 of the bent body 1 may have one or more bent regions 5.

Figure 5:
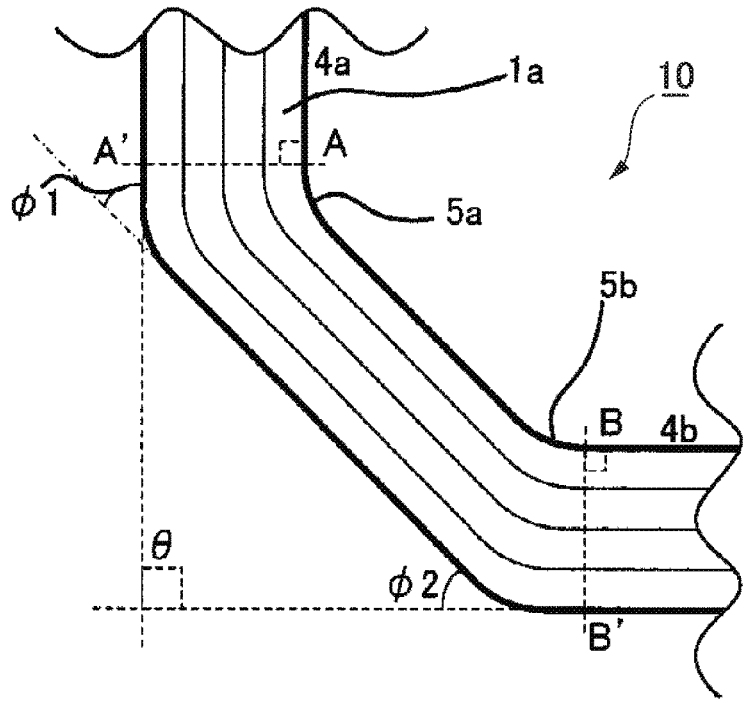
FIG. 5 is an enlarged side view of the vicinity of a corner portion of the wound core according to first embodiment of the present invention.

FIG. 5 is an enlarged side view of the vicinity of the corner portion 3 in the wound core 10 according to this embodiment.

As shown in FIG. 5, in a case where one corner portion has two bent regions 5*a* and 5*b*, the bent region 5*a* (curved portion) is connected to a straight-line portion representing a flat portion 4*a* of a bent body 10, and then, from the tip of the bent region 5*a*, a straight-line portion, the bent region 5*b* (curved portion), and a flat portion 4*b* are connected.

In the wound core 10 according to this embodiment, a region from a segment A-A' to a segment B-B' in FIG. 5 is the corner portion 3. A point A is an end point on the flat portion 4*a* side in the bent region 5*a* of the bent body 1*a* disposed on the innermost side of the wound core 10, and a point A' is a point of intersection between a straight line in a direction perpendicular to the sheet surface of the bent body 1*a* through the point A and the outermost surface of the wound core 10. Similarly, a point B is an end point on the flat portion 4*b* side in the bent region 5*b* of the bent body 1*a* disposed on the innermost side of the wound core 10, and a point B' is a point of intersection between a straight line in a direction perpendicular to the sheet surface of the bent body 1*a* through the point B and the outermost surface of the wound core 10. In FIG. 5, the angle between the two flat portions 4*a* and 4*b* adjacent to each other with the corner portion 3 interposed therebetween is θ, and θ in the present invention is approximately 90°. Although the bending angles φ of the bent regions 5*a* and 5*b* will be described later, φ1+φ2 in FIG. 5 is approximately 90°.

Figure 6:
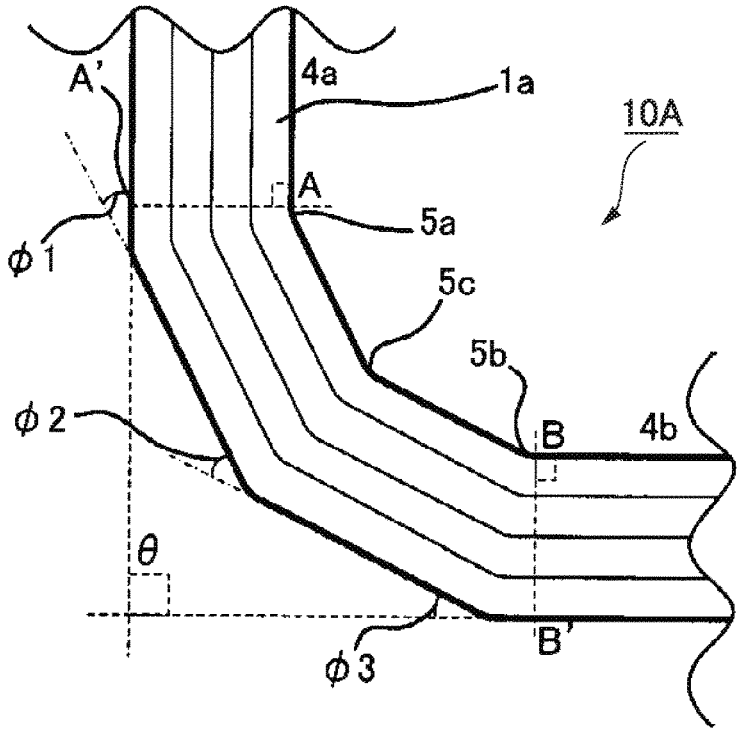
FIG. 6 is an enlarged side view of the vicinity of a corner portion in the wound core according to the first modification example.

Next, a case where one corner portion 3 has three bent regions 5 will be described. FIG. 6 is an enlarged side view of the vicinity of the corner portion 3 in the wound core 10A according to the first modification example shown in FIG. 3. In FIG. 6, as in FIG. 5, the region from the segment A-A' to the segment B-B' is the corner portion 3. In FIG. 6, the point A is the end point on the flat portion 4*a* side of the bent region 5*a* closest to the flat portion 4*a*, and the point B is the end point on the flat portion 4*b* side of the bent region 5*b* closest to the flat portion 4*b*. In a case where there are three bent regions 5, a straight-line portion is present between the bent regions. Flat parts forming the flat portions 4*a* and 4*b* can be determined in consideration that the angle θ between the two adjacent flat portions 4*a* and 4*b* with the corner portion 3 interposed therebetween is 90°, and accordingly, the bent region 5 adjacent to the flat portion 4 is determined. In the example of FIG. 6, φ1+φ2+φ3 becomes approximately 90°. In general, in a case where the corner portion 3 has n bent regions 5, φ1+φ2+ . . . +φn becomes approximately 90°.

Figure 7:
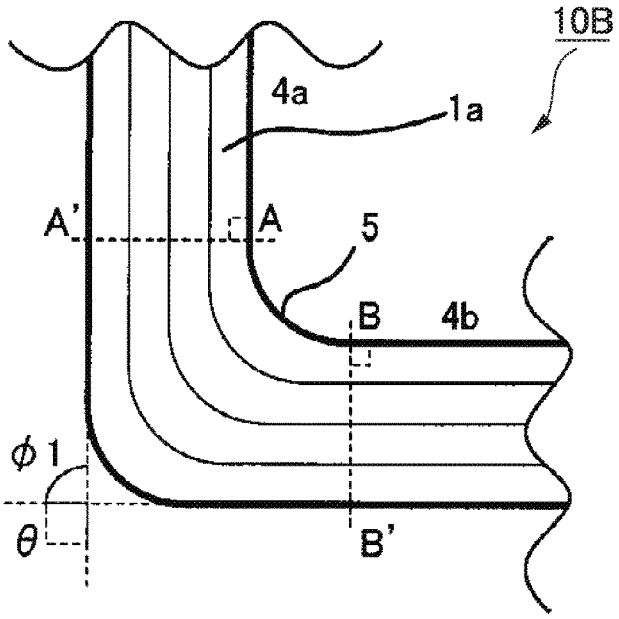
FIG. 7 is an enlarged side view of the vicinity of a corner portion in the wound core according to the second modification example.

Next, a case where one corner portion 3 has one bent region 5 will be described. FIG. 7 is an enlarged side view of the vicinity of the corner portion 3 in a wound core 10B according to a second modification example shown in FIG. 4. In FIG. 7, as in FIGS. 5 and 6, the region from the segment A-A' to the segment B-B' is the corner portion 3. In FIG. 7, the point A is the end point on the flat portion 4*a* side of the bent region 5, and the point B is the end point on the flat portion 4*b* side of the bent region 5. In the example of FIG. 7, φ1 is approximately 90°.

In this application, since the angle θ of the corner portion described above is approximately 90°, φ is approximately 90° or less. From the viewpoint of suppressing core loss by suppressing the generation of deformation twins, φ is preferably 60° or less, and more preferably 45° or less. Therefore, it is preferable that one corner portion 3 has two or more bent regions 5. However, it is difficult to form four or more bent regions 5 in one corner portion 3 due to restrictions on the design of manufacturing facilities. Therefore, the number of bent regions 5 in one corner portion is preferably three or less.

As in the wound core 10 according to this embodiment shown in FIG. 5, in a case where one corner portion has two bent regions 5*a* and 5*b*, it is preferable that φ1=45° and φ2=45° are satisfied from the viewpoint of reducing core loss. However, for example, φ1=60° and φ2=30°, φ1=30° and φ2=60°, or the like may be satisfied.

As in the wound core 10A according to the first modification example shown in FIG. 6, in a case where one corner portion has three bent regions 5*a*, 5*b*, and 5*c*, it is preferable that φ1=30°, φ2=30°, and φ3=30° are satisfied from the viewpoint of reducing core loss.

Furthermore, since it is preferable that the bending angles are equal to each other from the viewpoint of production efficient, in a case where one corner portion has two bent regions 5*a* and 5*b* (FIG. 5), φ1=45° and φ2=45° are preferably satisfied, and in a case where one corner portion has three bent regions 5*a*, 5*b*, and 5*c* (FIG. 6), for example, φ1=30°, φ2=30°, and φ3=30° are preferably satisfied from the viewpoint of reducing core loss.

Figure 8:
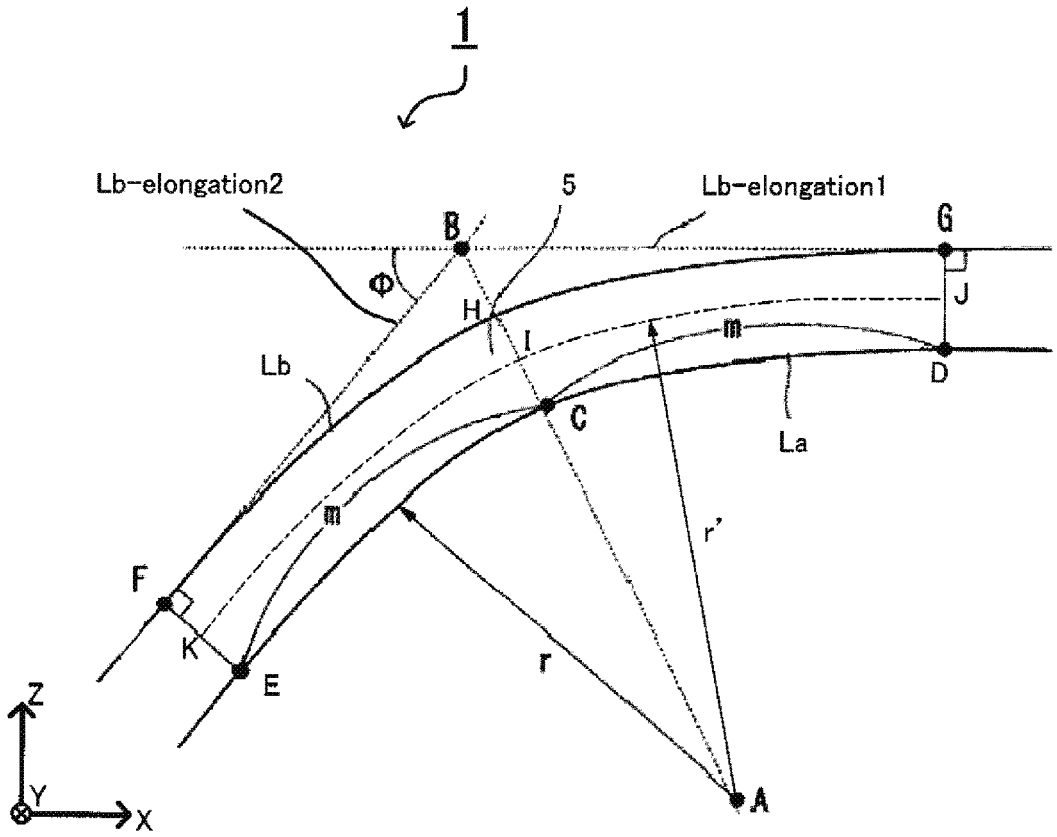
FIG. 8 is an explanatory view of a bent region.

The bent region 5 will be described in more detail with reference to FIG. 8. FIG. 8 is a view schematically showing an example of the bent region 5 of the bent body 1. The bending angle of the bent region 5 means an angular difference generated between a straight-line portion on the rear side and a straight-line portion on the front side in the bending direction in the bent region 5 of the bent body 1. Specifically, the bending angle of the bent region 5 is represented by a complementary angle φ of the angle between two imaginary lines Lb-elongation1 (Lb-Line 1) and Lb-elongation2 (Lb-Line 2) obtained by extending straight-line portions respectively adjacent to both sides (a point F and a point G) of a curved portion included in a line Lb representing the outer surface of the bent body 1, in the bent region 5.

The bending angle of each bent region 5 is approximately 90° or less, and the sum of the bending angles of all the bent regions 5 present in one corner portion 3 is approximately 90°.

In this application, the bent region 5 represents a region enclosed by, in a side view of the bent body 1, when a point D and a point E on a line La representing the inner surface of the bent body 1 and the point F and the point G on the line Lb representing the outer surface of the bent body 1 are defined as follows, a line delimited by the point D and the point E on the line La representing the inner surface of the bent body 1, a line delimited by the point F and the point G on the line Lb representing the outer surface of the bent body, a straight line connecting the point D and the point G, and a straight line connecting the point E and the point F.

Here, the points D, E, F, and G are defined as follows.

In a side view, a point at which a straight line AB connecting the center point A of the radius of curvature of a curved portion included in the line La representing the inner surface of the bent body 1 to the point of intersection B between the two imaginary lines Lb-elongation1 (Lb-Line 1) and Lb-elongation2 (LB-Line 2) obtained by extending the straight-line portions respectively adjacent to both sides of a curved portion included in the line Lb representing the outer surface of the bent body intersects the line representing the inner surface of the bent body 1 is referred to as the origin C, a point separated from the origin C by a distance m represented by Equation (1) in one direction along the line La representing the inner surface of the bent body 1 is referred to as the point D, a point separated from the origin C by the distance m in the other direction along the line La representing the inner surface of the bent body is referred to as the point E, the point of intersection between a straight-line portion opposing the point D in the straight-line portion included in the line Lb representing the outer surface of the bent body and an imaginary line drawn perpendicularly to the straight-line portion opposing the point D through the point D is referred to as the point G, and the point of intersection between a straight-line portion opposing the point E in the straight-line portion included in the line Lb representing the outer surface of the bent body and an imaginary line drawn perpendicularly to the straight-line portion opposing the point E through the point E is referred to as the point F.

Equation (1): $m=r\times(\pi/4)$ (in Equation (1), m represents the distance from the origin C, and r represents the distance (radius of curvature) from the center point A to the origin C).

That is, r represents the radius of curvature in a case where a curve near the origin C is regarded as an arc, and in this application, represents an inner surface side radius of curvature in a side view of the bent region 5. As the radius of curvature r decreases, the curve of the curved portion of the bent region 5 becomes sharp, and as the radius of curvature r increases, the curve of the curved portion of the bent region 5 becomes smooth.

In this application, even in a case where the bent region 5 having a radius of curvature r of 3 mm or less is formed by bending, the generation of deformation twins in the bent region 5 and cracking in the coating containing phosphorus are suppressed, so that a wound core having low core loss is obtained.

Figure 9:
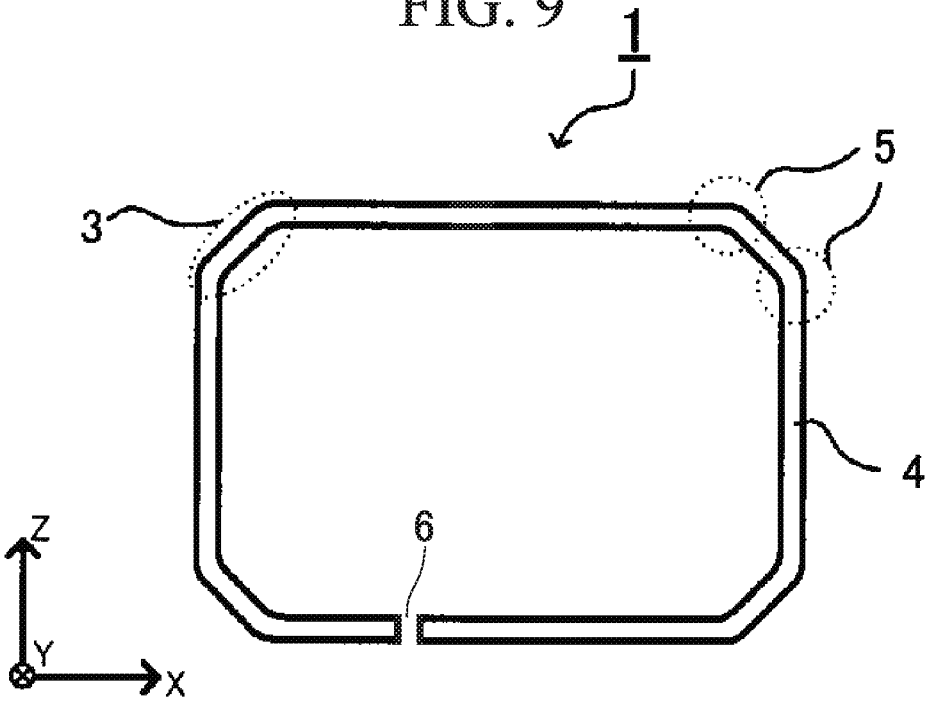
FIG. 9 is a side view of a bent body of the wound core according to the first embodiment of the present invention.

FIG. 9 is a view schematically showing the bent body 1 of the wound core 10 according to this embodiment. As shown in FIG. 9, the bent body 1 is formed by bending a grain-oriented electrical steel sheet and has four corner portions 3 and four flat portions 4, whereby one grain-oriented electrical steel sheet forms a substantially rectangular ring in a side view. More specifically, the bent body 1 has a structure in which one flat portion 4 has a joint portion 6 (gap) which is an end surface in the longitudinal direction, and the other three flat portions 4 have no joint portion 6.

Figure 10:
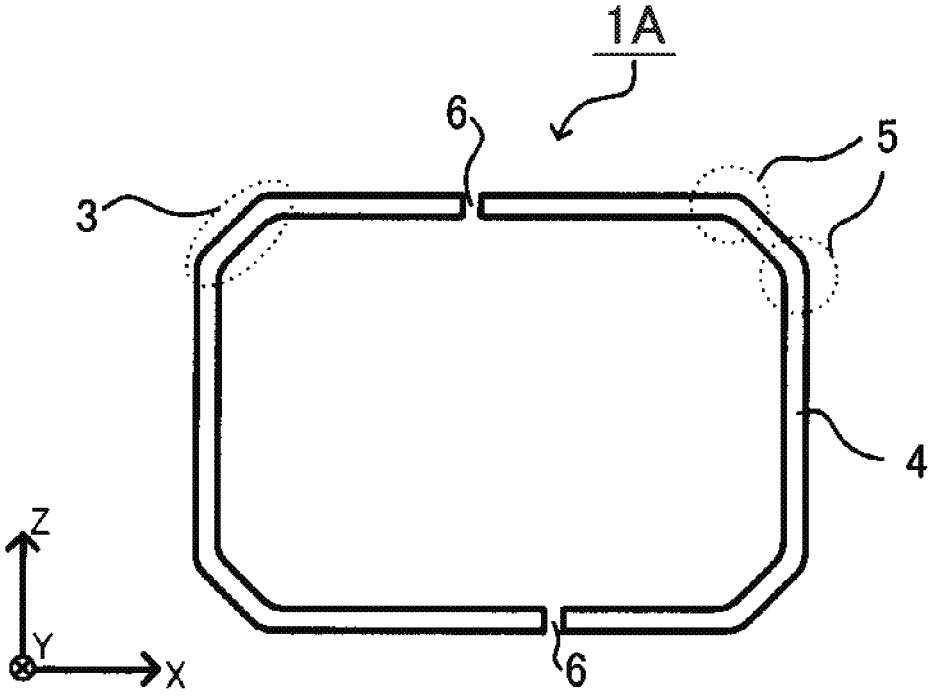
FIG. 10 is a side view showing a modification example of the bent body.

However, the wound core 10 may have a substantially rectangular laminated structure as a whole in a side view. Therefore, as a modification example, as shown in FIG. 10, a bent body 1A in which two flat portions 4 have joint portions 6 and the other two flat portions 4 have no joint portion 6 may be used. In this case, two grain-oriented electrical steel sheets constituted the bent body.

Figure 11:
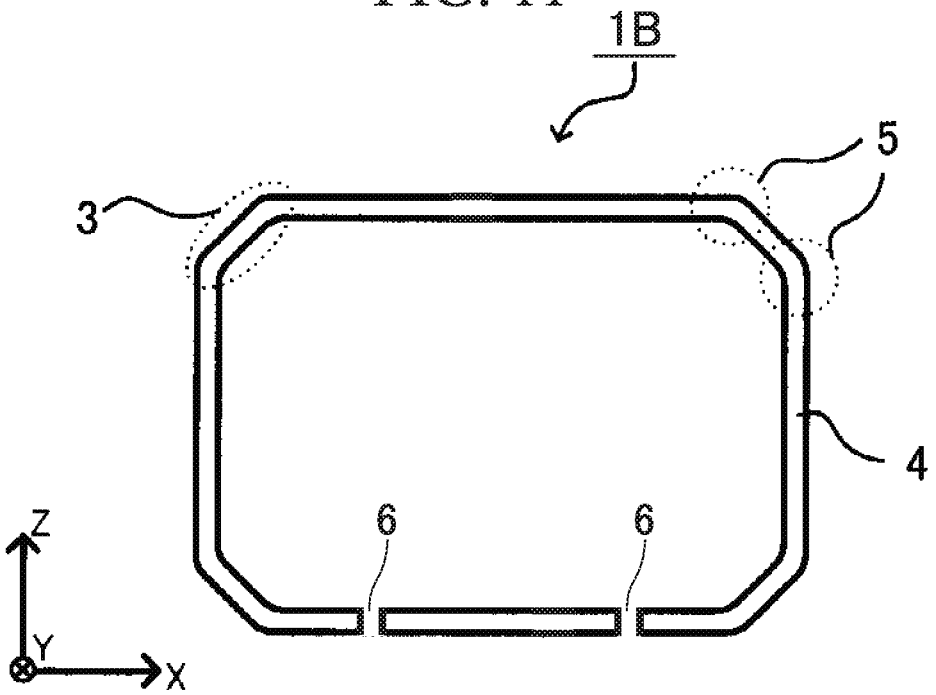
FIG. 11 is a side view showing another modification example of the bent body.

As another modification example in a case where two grain-oriented electrical steel sheets constitute a bent body, as shown in FIG. 11, a bent body 1B in which one flat portion 4 has two joint portions 6 and the other three flat portions 4 have no joint portion 6 may be used. That is, the bent body 1B is configured by combining a grain-oriented electrical steel sheet corresponding to three sides of substantially the rectangular shape and a straight (straight in a side view) grain-oriented electrical steel sheet corresponding to the remaining one side. In a case where two or more grain-oriented electrical steel sheets constitute a bent body as described above, a bent body of a steel sheet and a straight (straight in a side view) steel sheet may be combined.

In any case, so as not to cause a gap to be generated between two adjacent layers during manufacturing of the wound core, in two layers of the bent bodies adjacent to each other, the lengths of the steel sheets and the positions of the bent regions are adjusted so that the outer circumferential length of the flat portion 4 of the bent body disposed on the inner side and the inner circumferential length of the flat portion 4 of the bent body disposed on the outer side are equal to each other.

(Configuration of Grain-Oriented Electrical Steel Sheet)

The grain-oriented electrical steel sheet has at least a base steel sheet and a coating containing phosphorus on the surface of the base steel sheet, and may have other layers as necessary within the range in which the effects of the present invention are not impaired. Examples of the other layers include a glass coating provided between the base steel sheet and the coating containing phosphorus. Hereinafter, each configuration of the grain-oriented electrical steel sheet will be described.

(1) Base Steel Sheet

In the grain-oriented electrical steel sheet used in the wound core 10 according to this embodiment, the base steel sheet is a steel sheet in which the orientation of grains in the base steel sheet is highly integrated in a {110}<001> orientation and has excellent magnetic characteristics in a rolling direction.

The base steel sheet in the present invention is not particularly limited, and as the grain-oriented electrical steel sheet, a known grain-oriented electrical steel sheet can be appropriately selected and used. Hereinafter, an example of a preferable base steel sheet will be described, but the base steel sheet in the present invention is not limited to the following.

The chemical composition of the base steel sheet is not particularly limited, but is preferably includes, for example, by mass %, Si: 0.8% to 7%, C: higher than 0% and 0.085% or less, acid soluble Al: 0% to 0.065%, N: 0% to 0.012%, Mn: 0% to 1%, Cr: 0% to 0.3%, Cu: 0% to 0.4%, P: 0% to 0.5%, Sn: 0% to 0.3%, Sb: 0% to 0.3%, Ni: 0% to 1%, S: 0% to 0.015%, Se: 0% to 0.015%, and a remainder consisting of Fe and impurities. The chemical composition of the base steel sheet is a preferable chemical component for controlling the texture to a Goss texture in which the crystal orientation is integrated into a {110} <001> orientation. Among the elements in the base steel sheet, Si and C are base elements, and the acid soluble Al, N, Mn, Cr, Cu, P, Sn, Sb, Ni, S, and Se are selective elements. These selective elements may be contained for their purposes. Therefore, there is no need to limit the lower limits thereof, and the selective elements may not be substantially contained. Even if these selective elements are contained as unavoidable impurities, the effects of the present invention are not impaired. In the base steel sheet, the remainder of the base elements and the selective elements consists of Fe and unavoidable impurities.

However, in a case where the Si content of the base steel sheet is 2.0% or more in terms of mass %, the classical eddy current loss of a product is suppressed, which is preferable. The Si content of the base steel sheet is more preferably 3.0% or more.

In addition, in a case where the Si content of the base steel sheet is 5.0% or less in terms of mass %, cracking hardly occurs in the steel sheet during a hot rolling step and cold rolling, which is preferable. The Si content of the base steel sheet is more preferably 4.5% or less.

In this application, "unavoidable impurities" mean elements unavoidably incorporated from ores as raw materials, scrap, manufacturing environments, and the like when the base steel sheet is industrially produced.

In addition, the grain-oriented electrical steel sheet is generally subjected to purification annealing during secondary recrystallization. In the purification annealing, inhibitor forming elements are discharged to the outside of the system. Particularly, the concentrations of N and S are significantly reduced and reach 50 ppm or less. The concentrations reach 9 ppm or less or 6 ppm or less under typical purification annealing conditions, and reach a degree (1 ppm or less) that cannot be detected by general analysis when purification annealing is sufficiently performed.

The chemical composition of the base steel sheet may be measured by a general analysis method for steel. For example, the chemical composition of the base steel sheet may be measured using inductively coupled plasma-atomic emission spectrometry (ICP-AES). Specifically, for example, the chemical composition can be specified by obtaining a 35 mm square test piece from the center position of the base steel sheet after removing the coating and performing measurement under conditions based on a calibration curve created in advance by ICPS-8100 (measuring apparatus) manufactured by Shimadzu Corporation or the like. In addition, C and S may be measured using a combustion-infrared absorption method, and N may be measured using an inert gas fusion-thermal conductivity method.

The chemical composition of the base steel sheet is a composition obtained by analyzing the composition of the steel sheet as the base steel sheet, which is obtained by removing the glass coating described later, the coating containing phosphorus, and the like from the grain-oriented electrical steel sheet by a method described later.

A manufacturing method of the base steel sheet is not particularly limited, a manufacturing method of a grain-oriented electrical steel sheet, which is known in the related art, can be appropriately selected. A preferable specific example of the manufacturing method is a method of performing hot rolling by heating a slab containing 0.04 to 0.1 mass % of C and having the chemical composition of the base steel sheet to 1000° C. or higher, thereafter performing hot rolled sheet annealing as necessary, subsequently performing cold rolling once or two or more times with process annealing therebetween to form a cold rolled steel sheet, performing decarburization annealing by heating the cold rolled steel sheet to 700° C. to 900° C., for example, in a wet hydrogen-inert gas atmosphere, further performing nitriding annealing thereon as necessary, and performing finish annealing at about 1000° C.

The thickness of the base steel sheet is not particularly limited, but may be, for example, 0.1 mm or more and 0.5 mm or less or may be 0.15 mm or more and 0.40 mm or less.

Furthermore, as the grain-oriented electrical steel sheet, it is preferable to use a steel sheet in which magnetic domains are refined by application of local strain to the surface or formation of grooves in the surface. By using such a steel sheet, the core loss can be further suppressed.

(2) Coating Containing Phosphorus

The grain-oriented electrical steel sheet has the coating containing phosphorus mainly for imparting insulating properties. The coating containing phosphorus is provided on the outermost surface of the grain-oriented electrical steel sheet, and in a case where the grain-oriented electrical steel sheet has the glass coating or an oxide coating, which will be described later, is provided on each of the coatings.

The coating containing phosphorus can be appropriately selected from among those known in the related art. As the coating containing phosphorus, a phosphate-based coating is preferable, and a coating containing one or more of aluminum phosphate and magnesium phosphate and as a main component and containing one or more of chromium and silicon oxide as an auxiliary component is preferable. With the phosphate-based coating, the insulating properties of the steel sheet are secured, and tension is applied to the steel sheet, so that the steel sheet is also excellent in a reduction in core loss.

A method of forming the coating containing phosphorus is not particularly limited, and can be appropriately selected from known methods. For example, a method of applying a coating solution, in which a coating composition is dissolved, onto the base steel sheet, and baking the resultant is preferable. Hereinafter, a preferable specific example will be described, but the method of forming the coating containing phosphorus is not limited thereto.

A coating solution containing 4 to 16 mass % of colloidal silica, 3 to 24 mass % of aluminum phosphate (calculated as aluminum biphosphate), and 0.2 to 4.5 wt % in total of one or two or more of chromic anhydride and dichromate is prepared. The coating solution is applied onto the base steel sheet or the other coatings such as the glass coating formed on the base steel sheet, and is baked at a temperature of about 350° C. or higher. Thereafter, a heat treatment is performed thereon at 800° C. to 900° C., whereby the coating containing phosphorus can be formed. The coating formed as described above has insulating properties and can apply tension to the steel sheet, thereby improving core loss and magnetostriction characteristics.

The thickness of the coating containing phosphorus is not particularly limited, but is preferably 0.5 μm or more and 3 μm or less from the viewpoint of securing the insulating properties.

(3) Other Coatings

The grain-oriented electrical steel sheet may further have coatings other than the base steel sheet and the coating which is formed on the outermost surface and contains phosphorus, in a range in which the effects of the present invention are not impaired. Examples of such other coatings include the glass coating formed on the base steel sheet. The grain-oriented electrical steel sheet preferably has the glass coating from the viewpoint of improving the adhesion of the coating containing phosphorus. Examples of the glass coating include coatings having one or more oxides selected from forsterite ($Mg_2SiO_4$), spinel ($MgAl_2O_4$), and cordierite ($Mg_2Al_4Si_5O_{16}$).

A method of forming the glass coating is not particularly limited, and can be appropriately selected from known methods. For example, in a specific example of the manufacturing method of the base steel sheet, a method of applying an annealing separating agent containing one or more selected magnesia (MgO) and alumina ($Al_2O_3$) to a cold-rolled steel sheet and performing finish annealing thereon can be employed. The annealing separating agent also has an effect of suppressing sticking between steel sheets during finish annealing. For example, in a case where finish annealing is performed by applying the annealing separating agent containing magnesia, the annealing separating agent reacts with silica contained in the base steel sheet such that a glass coating containing forsterite ($Mg_2SiO_4$) is formed on the surface of the base steel sheet.

The thickness of the glass coating is not particularly limited, but is preferably 0.5 μm or more and 3 μm or less from the viewpoint of adhesion to the coating containing phosphorus and the like.

The thickness of the grain-oriented electrical steel sheet is not particularly limited and may be appropriately selected according to the application and the like, but it is typically in a range of 0.15 mm to 0.35 mm, and preferably in a range of 0.18 mm to 0.23 mm.

(Characteristics of Bent Portion)

In the wound core 10 according to this embodiment, in a side view, the number of deformation twins present in the bent region 5 is five or less per 1 mm of the length of the center line in the sheet thickness direction in the bent region 5.

That is, in a case where the length of the center line in the sheet thickness direction in "all the bent regions 5 included in one corner portion 3 of one bent body 1 of the wound core 10" is referred to as $L_{Total}$ (mm) and the number of deformation twins included in "all the bent regions 5 included in one corner portion 3 of one bent body 1 of the wound core 10" is referred to as $N_{Total}$ (count), the value of $N_{Total}/L_{Total}$ (count/mm) is five or less.

The number of deformation twins present in the bent region 5 is preferably four or less per 1 mm of the length of the center line in the sheet thickness direction in the bent region 5 and is more preferably three or less.

Furthermore, in the wound core 10 according to this embodiment, the amount of phosphorus eluted from the corner portion 3 in a case where the wound core 10 is boiled in water for 30 minutes is 6.0 mg or less per 1 $m^2$ of the surface area of the corner portion 3.

That is, in a case where the amount of phosphorus eluted from "one corner portion 3 of one bent body 1 of the wound core 10" is referred to as Peiution (mg) and the surface area of "one corner portion 3 of one bent body 1 of the wound core 10" is referred to as $S_A$ ($m^2$), the value of $P_{elution}/S_A$ ($mg/m^2$) is 6.0 or less.

The amount of phosphorus eluted from the corner portion 3 per 1 $m^2$ of the surface area of the corner portion 3 in a case where the wound core 10 is boiled in water for 30 minutes is preferably 5 mg or less, and more preferably 4 mg or less.

Hereinafter, the number of deformation twins and the amount of eluted phosphorus will be described in detail.

(1) Number of Deformation Twins

The number of deformation twins present in the bent region 5 in a side view, a cross section of the bent region 5 may be photographed using an optical microscope, and the number of deformation twins 7 directed from the surface of the steel sheet to the inside may be counted up. As shown in the example in FIG. 15, deformation twins are formed on the outer circumferential surface of the wound core and the inner circumferential surface of the wound core of the steel sheet. In this application, deformation twins formed on the outer circumferential surface and deformation twins formed on the inner circumferential surface are added. In addition, deformation twins can be confirmed by analysis and evaluation using the scanning electron microscope and the crystal orientation analysis software (EBSD).

Here, a method of preparing a sample for observing of the cross section of the bent region 5 will be described using the wound core 10 according to this embodiment as an example.

Figure 12:
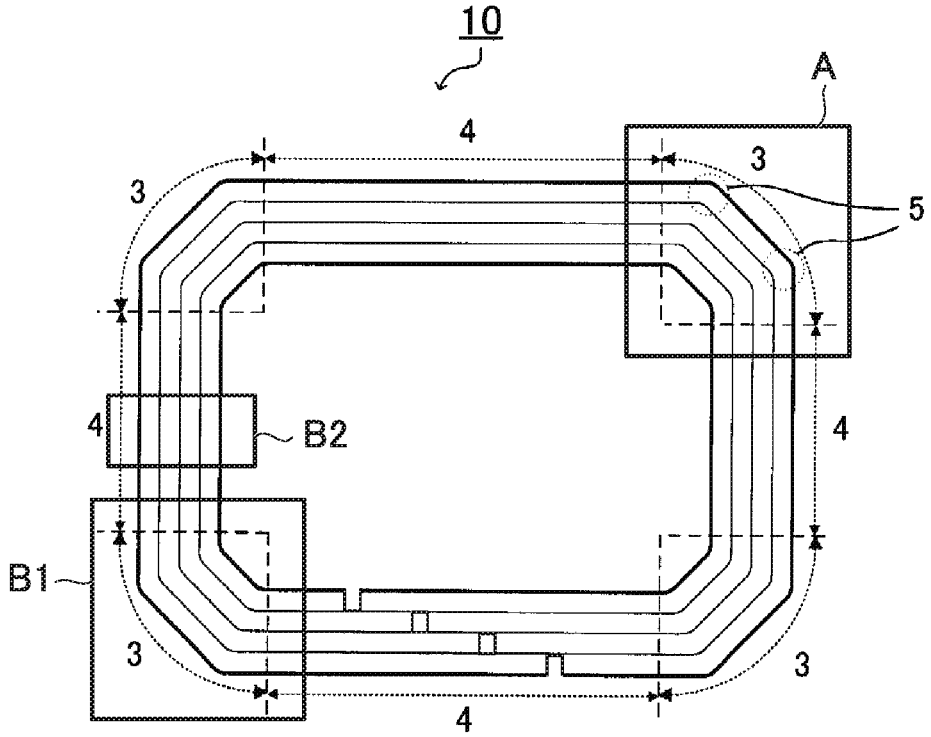
FIG. 12 is a side view showing an example of a taking position of a sample of the wound core.

As shown in FIG. 12, the sample for observing the section of the bent region 5 is taken from the corner portion 3 (region A shown in the figure) corresponding each of the plurality of bent bodies 1 constituting the wound core 10. From this region A, a sample including the bent region 5 is taken using a shearing machine. At this time, the clearance from a shearing blade is set to 0.1 to 2 mm and shearing is performed so that the shear section does not cross the bent region 5. In addition, it is difficult to shear the overlapped bent bodies 1 at once, so that the bent bodies 1 are sheared one by one.

Next, in a state where members sheared one by one are overlapped, one side of the sheet width is embedded in an epoxy resin, and the embedded surface is polished. In polishing, SiC sandpaper is changed from sandpaper #80 having a grain size in JIS R 6010 into #220, #600, #1000, and #1500 in this order, and then, diamond polishing is performed for mirror finish by using 6 μm diamond powder, 3 μm diamond powder, and 1 μm diamond powder in this order.

Last, in order to corrode the structure, the sample is immersed in a solution obtained by adding two to three drops of picric acid and hydrochloric acid to 3% Nital for about 20 seconds to corrode the structure, whereby the sample for observing the cross section of the bent region 5 is prepared.

In addition, the length of the center line in the sheet thickness direction of the grain-oriented electrical steel sheet is the length of a curve KJ in FIG. 8, and is specifically determined as follows. A point where the straight line AB defined as described above and the line representing the outer side of the grain-oriented electrical steel sheet intersect is referred to as a point H, and the midpoint between the point H and the origin C is referred to as a point I. At this time, the distance (radius of curvature) between the midpoint A to the point I is referred to as r', and m' is calculated by Equation (2). At this time, the length of the center line in the sheet thickness direction of the grain-oriented electrical steel sheet becomes twice m' (2 m'). In addition, a point K is the midpoint of a segment EF, and a point J is the midpoint of a segment GD.

$$m'=r'\times(\pi/4) \quad \text{Equation (2):}$$

(in Equation (2), m' represents the length from the point I to the point K and the point J, and r' represents the distance from the midpoint A to the point I (radius of curvature)).

As described above, the taken sample is formed by overlapping the members sheared one by one and therefore includes the plurality of bent regions 5. Therefore, the number of deformation twins included in the corresponding bent region 5 per 1 mm of the length of the center line in the sheet thickness direction in the bent region 5 can be obtained based on the total length of the center lines of all the bent regions 5 in the sample and the number of deformation twins present in all the bent regions 5 in the sample.

(2) Amount of Eluted Phosphorus

In a case where cracks of the coating are present in the bent region 5, phosphorus is eluted from the cracked parts when the wound core 10 is boiled in water. Therefore, in this application, the amount of phosphorus eluted from the corresponding corner portion 3 per 1 $m^2$ of the surface area of the corner portion in a case where the wound core 10 is boiled in water for 30 minutes is used as an index of easiness of occurrence of sticking between the steel sheets in the bent region 5.

Here, a method of preparing a sample for measuring the amount of phosphorus eluted from the corner portion 3 will be described using the wound core 10 according to this embodiment as an example.

As shown in FIG. 12, the sample for measuring the amount of phosphorus eluted from the corner portion 3 is taken from the corner portion 3 (region B1 shown in the figure) and the flat portion 4 (region B2 shown in the figure) corresponding to each of the plurality of bent bodies 1 constituting the wound core 10. From the region B1, a sample including portions of the corner portion 3 and the flat portions 4 and 4 adjacent to the corner portion 3 is taken using the shearing machine. From the region B2, a sample including only a flat sheet portion is taken using the shearing machine. At this time, shearing is performed so that the area of the flat sheet portion 4 of the sample taken from the region B1 and the area of the flat sheet portion 4 of the sample taken from the region B2 are the same. The area of the flat sheet portion is not particularly limited, but for example, the area of one sheet of the sample taken from the region B2 is appropriately set to an area with a width of 30 mm and a length of 280 mm or the like. In any taking operation, the clearance from the shearing blade is set to about 0.1 to 2 mm, and shearing is performed so that the shear section does not cross the bent region 5. In addition, it is difficult to shear the overlapped bent bodies 1 at once, so that the bent bodies 1 are sheared one by one.

Next, the samples taken from the region B1 and the region B2 are respectively put in the same amount of water, and boiled at about 100° C. for 30 minutes, and thereafter phosphorus eluted into water is measured as phosphate ions by molybdenum blue (ascorbic acid reduction) absorptiometry. The amount of phosphorus eluted from the sample taken from the region B1 is referred to as $P_{B1}$, the amount of phosphorus eluted from the sample taken from the region B2 is referred to as $P_{B2}$, and by calculating $P_{B1}-P_{B2}$, the amount of phosphorus eluted from the corner portion 3 is obtained.

As described above, since the sample is an assembly of the members taken from the plurality of bent bodies 1, the amount of phosphorus eluted from the corner portion 3 per 1 $m^2$ of the surface area of the corner portion in a case where the corner portion is boiled in water for 30 minutes can be obtained based on the sum of the surface areas of the members (the corner portions 3 of the bent bodies 1) and the amount of eluted phosphorus calculated by $P_{B1}-P_{B2}$.

The surface area of one corner portion of one bent body can be calculated by the calculation formula (the length in the long side direction of the center line in the thickness direction of the bent body 1)×(the width of the bent body 1)×2.

In order to measure the amount of phosphorus eluted from the corner portion 3, it is also conceivable to shear a member including only the corner portion to obtain a sample among samples taken from the region B1. However, in this case, there is concern that a region close to a bent portion may be sheared, and there is concern that accurate measurement results may not be obtained. Therefore, as described above in this application, samples are respectively taken from the region B1 and the region B2.

In addition, the present inventors measured the amount of eluted phosphorus by variously changing the size of the sample cut out by shearing. As a result, it was confirmed that the effect of elusion of phosphorus from a side surface portion (cut surface) of the sample is extremely small, and according to the above-described method, when the area of the surface layer of the grain-oriented electrical steel sheet in which the coating containing phosphorus is present is the same even if the cut area is different, the amount of phosphorus eluted therefrom per unit area is the same.

As described above, in the wound core 10 according to this embodiment, the number of deformation twins in the bent region 5 is small and the amount of phosphorus eluted from the corner portion 3 is small, so that the core loss is suppressed while the bent region 5 is provided. Therefore, the wound core 10 according to this embodiment can be suitably used for any of applications known in the related art, such as magnetic cores of transformers, reactors, noise filters, and the like.

Second Embodiment

Hereinafter, a manufacturing method of the wound core 10 will be described. A manufacturing method of a wound core according to a second embodiment of the present invention includes a preparation step of preparing a plurality of grain-oriented electrical steel sheets having a coating containing phosphorus on the surface, a bending step of forming a plurality of bent bodies having a substantially rectangular shape in a side view by bending each corner portion forming region previously allocated to the plurality of grain-oriented electrical steel sheets in a state in which the temperature of the corner portion forming region is set to 150° C. or higher and 500° C. or lower, and a lamination step of laminating the plurality of bent bodies in the sheet thickness direction.

According to the manufacturing method, the wound core with low core loss while having the bent region 5 can be manufactured. Hereinafter, the manufacturing method of the wound core will be described in detail in order.

(Preparation Step)

First, grain-oriented electrical steel sheets having a coating containing phosphorus on the surface are prepared. The grain-oriented electrical steel sheets may be manufactured, or commercially available products may be obtained. The manufacturing method and chemical composition of the grain-oriented electrical steel sheet are as described above, so that the description thereof will be omitted here.

(Bending Step)

Next, the grain-oriented electrical steel sheet is cut into a desired length as necessary, and thereafter at least one portion in each corner portion forming region previously allocated to the grain-oriented electrical steel sheet is bent. Accordingly, the grain-oriented electrical steel sheet is formed into the bent body 1 in which flat portions and corner portions are alternately connected and the angle between the two flat portions adjacent to each corner portion is approximately 90°.

Figure 13:
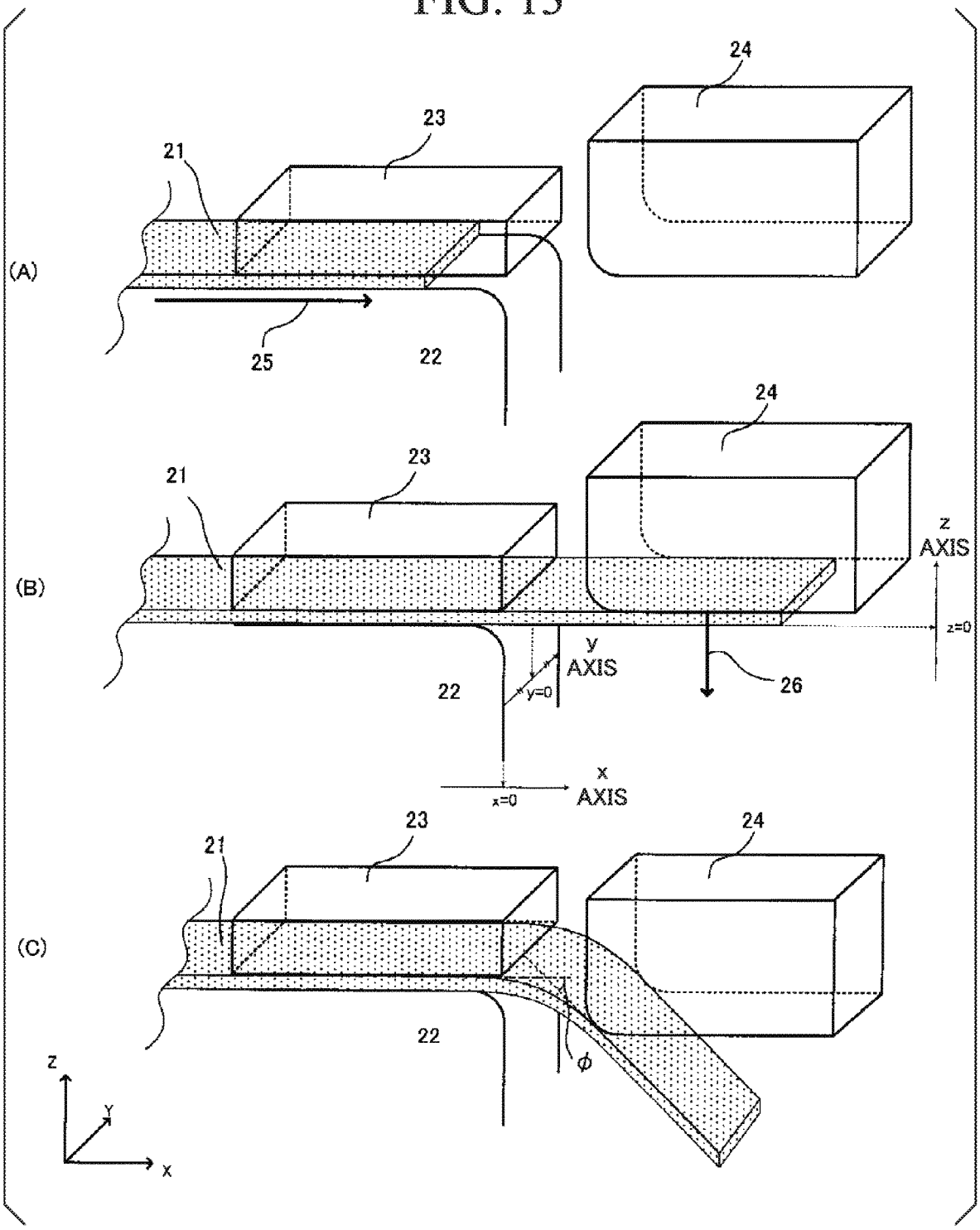
FIG. 13 is an explanatory view of a bending step in a manufacturing method of the wound core according to a second embodiment of the present invention.
Figure 14:
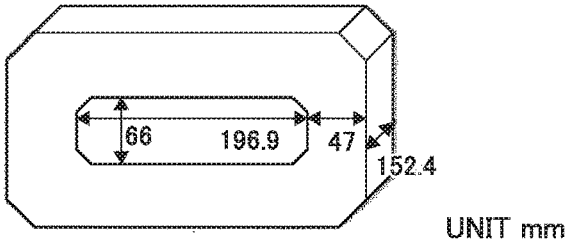
FIG. 14 is a schematic view showing the dimensions of a wound core manufactured in an example.

A bending method of will be described with reference to the drawings. FIG. 13 is a schematic view showing an example of the bending method in the manufacturing method of the wound core 10.

The configuration of a working machine is not particularly limited, but for example, as shown in (A) of FIG. 13, includes a die 22 and a punch 24 for press working, and also includes a guide 23 for fixing a grain-oriented electrical steel sheet 21. The grain-oriented electrical steel sheet 21 is conveyed in a conveyance direction 25 and is fixed at a preset position ((B) of FIG. 13). Subsequently, the grain-oriented electrical steel sheet 21 is pressed by the punch 24 at a predetermined force set in advance, whereby a bent body having a bent region at a bending angle φ is obtained.

In the bending step, the temperature of the corner portion forming region is controlled to 150° C. or higher and 500° C. or lower. This is because, by setting the temperature range, the generation of deformation twins can be suppressed, and cracking in the coating containing phosphorus can be suppressed.

Here, a region for which the temperature is controlled may be only the region bent during bending. That is, the temperature of the flat sheet portion is not particularly limited. However, in a case where a steel sheet in which local strain is applied to the surface in order to refine the magnetic domains is used as the grain-oriented electrical steel sheet, it is preferable to control the temperature of regions excluding the corner portion forming region to 300° C. or lower while controlling the temperature of the corner portion forming region to 150° C. or higher and 500° C. or lower.

The temperature of the corner portion forming region is obtained by, for example, installing a thermocouple in the punch 24 and measuring the temperature when the punch 24 comes into contact with the grain-oriented electrical steel sheet 21. A method of controlling the temperature of the corner portion forming region in the grain-oriented electrical steel sheet to 150° C. or higher and 500° C. or lower is not particularly limited, and for example, the temperature can be controlled by heating the member that is in contact with the grain-oriented electrical steel sheet, such as the die 22, or using an infrared heater or the like. In a case of heating the die 22, the temperature is appropriately set depending on the thickness, conveyance time, and the like of the steel sheet, but as a reference, the temperature of the die 22 may be set to 200° C. to 500° C.

Here, the temperature of the grain-oriented electrical steel sheet during bending is measured as follows. First, in (B) of FIG. 13, assuming that the conveyance direction 25 (the longitudinal direction of the grain-oriented electrical steel sheet) of the grain-oriented electrical steel sheet 21 is the x axis, the width direction of the steel sheet 21 is the y axis, the sheet thickness direction of the steel sheet is the z axis, the origin is defined by setting a surface of the die 22 on a side close to the punch 24 to x=0, the center in the width direction of the grain-oriented electrical steel sheet to y=0, and the surface of the grain-oriented electrical steel sheet on the die 22 side to z=0 (the positions of x=0, y=0, and z=0 are shown in (B) of FIG. 11). At this time, the average value of the temperature of the origin (0,0,0) and the temperature at the surface (that is, a point (0,0,t)) on the side opposite to the die 22 at the origin is defined as the temperature of the grain-oriented electrical steel sheet during bending. The temperatures of the origin (0,0,0) and the point (0,0,t) can be evaluated by measuring temperatures when the punch comes into contact with the steel sheet with the thermocouple. In addition, t is the sheet thickness of the grain-oriented electrical steel sheet.

(Lamination Step)

Next, in the lamination step, a plurality of the bent bodies are laminated in the sheet thickness direction. That is, the corner portions 3 of the bent bodies 1 are aligned with each other to be overlapped and laminated in the sheet thickness direction, whereby forming a laminate having a substantially rectangular shape in a side view. Accordingly, a wound core can be obtained. The obtained wound core may further be fixed using a known binding band or a fastening tool as necessary.

The present invention is not limited to the embodiment. The embodiment is an example and anything having substantially the same configuration as the technical spirit described in the claims of the present invention and exhibiting the same operational effect can be included in the technical scope of the present invention.

For example, in the above description, the case where four bent bodies 1 are laminated is described, but the number of bent bodies 1 to be laminated is not limited.

EXAMPLES

Hereinafter, the technical contents of the present invention will be further described with reference to examples of the present invention. The conditions in the following examples are examples of conditions adopted to confirm the feasibility and effects of the present invention, and the present invention is not limited to the examples of conditions. Furthermore, the present invention can adopt various conditions without departing from the gist of the present invention as long as the object of the present invention is achieved.

As Experimental Examples A1 to A14, grain-oriented electrical steel sheets in which a glass coating (thickness 1.0 μm) containing forsterite ($Mg_2SiO_4$) and a coating (thickness 2.0 μm) containing aluminum phosphate were formed in this order on a base steel sheet having a thickness of 0.27 mm and furthermore, magnetic domains were refined by performing laser irradiation on the surface of the steel sheet at intervals of 4 mm in a direction perpendicular to the rolling direction were prepared.

Corner portion forming regions of the grain-oriented electrical steel sheets were bent while adjusting the corner portion forming regions to a temperature range of 25° C. to 1000° C., whereby bent bodies having bent regions with a bending angle φ of 45° were obtained. Next, by laminating the bent bodies, a wound core having dimensions shown in FIG. 12 was obtained.

In addition, in Experimental Examples B1 to B14, C1 to C14, and D1 to D14, similar wound cores were obtained using grain-oriented electrical steel sheets in which the thicknesses of the base steel sheets were respectively set to 0.23 mm, 0.20 mm, and 0.18 mm.

[Measurement of Number of Deformation Twins]

From the wound cores of the experimental examples, samples were sheared from the region A shown in FIG. 12. The samples were observed with the optical microscope, and the number of deformation twins present in each bent region of the bent body around about 1 mm of the length of the center line in the sheet thickness direction was calculated. The results are shown in Tables 1 and 2.

In addition, the deformation twins were confirmed by analysis and evaluation using the scanning electron microscope and the crystal orientation analysis software (EBSD).

[Measurement of Amount of Eluted Phosphorus]

From the wound cores of the experimental examples, samples were sheared from the regions B1 and B2 shown in FIG. 12.

At this time, shearing was performed so that the flat sheet portion of the samples obtained from the regions B1 and B2 had a size with a width of 30 mm and a length of 280 mm.

Each of the samples was put in 200 cc of water and was boiled at about 100° C. for 30 minutes, and thereafter, phosphorus eluted into water was measured as phosphate ions by molybdenum blue (ascorbic acid reduction) absorptiometry. The amount of phosphorus eluted from the corner portion was calculated from the difference between the amount $P_{B1}$ of phosphorus eluted from the sample taken from the region B1 and the amount $P_{B2}$ of phosphorus eluted from the sample taken from the region B2. The results are shown in Tables 1 and 2.

In addition, phosphate ions in water were measured in advance, and it was confirmed that the amount was less than the lower limit of detection (0.005 mg/lit).

In addition, in measurement of the amount of eluted phosphorus, a sample having a width of 50 mm and a length of 336 mm was prepared and measurement of the amount of eluted phosphorus was similarly performed. Accordingly, it was confirmed that the amount of phosphorus eluted per unit area was the same as that of the sample having a width of 30 mm and a length of 280 mm.

[Evaluation]

(1) Measurement of Core Loss Value of Wound Core

Regarding each of the wound cores of the experimental examples, measurement in an exciting current method in a measurement method of the magnetic characteristics of a flat rolled magnetic steel strip by an Epstein tester described in JIS C 2550-1 was performed under the conditions of a frequency of 50 Hz and a magnetic flux density of 1.7 T, and the core loss value $W_A$ was obtained.

(2) Measurement of Core Loss Value of Grain-Oriented Electrical Steel Sheet

From the wound cores of the experimental examples, the grain-oriented electrical steel sheets were taken and sheared, samples formed of only the flat sheet portion and having a width of 60 mm and a length of 300 mm were taken, measurement in an electrical steel sheet single sheet magnetic characteristic test by an H coil method described in JIS C 2556 was performed under the conditions of a frequency of 50 Hz and a magnetic flux density of 1.7 T, and the core loss value $W_B$ was obtained.

(3) Building Factor

The building factor (BF) was obtained by dividing the core loss value $W_A$ of the wound core obtained in (1) described above by the core loss value $W_B$ of the electrical steel sheet single sheet obtained in (2) described above. In the present invention, as the BF decreases, sticking between the base steel sheets does not occur during lamination, and the wound core can be evaluated to have reduced core loss. In this application, a case where the BF value is less than 1.00 is taken as an invention example.

The results are shown in Tables 1 and 2.

TABLE 1

| | Sheet thickness (mm) | Steel sheet temperature during working (° C.) | Number of twin (count/mm) | Amount of eluted phosphorus (mg/m²) | Core loss $W_A$ of steel sheet (W/kg) | Core loss $W_B$ of steel sheet (W/kg) | BF [$W_A/W_B$] | Classification |
|---|---|---|---|---|---|---|---|---|
| Example A1 | 0.27 | 25 | 11 | 32.0 | 0.940 | 0.810 | 1.16 | Comparative Example |
| Example A2 | 0.27 | 50 | 9 | 33.0 | 0.890 | 0.817 | 1.09 | Comparative Example |
| Example A3 | 0.27 | 80 | 9 | 39.9 | 0.870 | 0.813 | 1.07 | Comparative Example |
| Example A4 | 0.27 | 100 | 6 | 25.5 | 0.780 | 0.780 | 1.00 | Comparative Example |
| Example A5 | 0.27 | 150 | 5 | 5.5 | 0.795 | 0.820 | 0.97 | Invention Example |
| Example A6 | 0.27 | 200 | 5 | 4.4 | 0.797 | 0.822 | 0.97 | Invention Example |
| Example A7 | 0.27 | 300 | 3 | 1.4 | 0.775 | 0.807 | 0.96 | Invention Example |
| Example A8 | 0.27 | 400 | 2 | 3.1 | 0.765 | 0.814 | 0.94 | Invention Example |
| Example A9 | 0.27 | 500 | 2 | 3.6 | 0.758 | 0.806 | 0.94 | Invention Example |
| Example A10 | 0.27 | 600 | 2 | 14.5 | 0.895 | 0.814 | 1.10 | Comparative Example |
| Example A11 | 0.27 | 700 | 1 | 12.7 | 0.899 | 0.817 | 1.10 | Comparative Example |
| Example A12 | 0.27 | 800 | 1 | 16.9 | 0.901 | 0.812 | 1.11 | Comparative Example |
| Example A13 | 0.27 | 900 | 2 | 28.9 | 0.896 | 0.800 | 1.12 | Comparative Example |
| Example A14 | 0.27 | 1000 | 1 | 32.4 | 0.904 | 0.800 | 1.13 | Comparative Example |
| Example B1 | 0.23 | 25 | 11 | 32.0 | 0.957 | 0.839 | 1.14 | Comparative Example |
| Example B2 | 0.23 | 50 | 9 | 33.0 | 0.827 | 0.780 | 1.06 | Comparative Example |
| Example B3 | 0.23 | 80 | 9 | 39.9 | 0.796 | 0.765 | 1.04 | Comparative Example |
| Example B4 | 0.23 | 100 | 6 | 25.5 | 0.736 | 0.736 | 1.00 | Comparative Example |
| Example B5 | 0.23 | 150 | 5 | 4.8 | 0.650 | 0.692 | 0.94 | Invention Example |
| Example B6 | 0.23 | 200 | 5 | 3.2 | 0.664 | 0.699 | 0.95 | Invention Example |
| Example B7 | 0.23 | 300 | 3 | 1.3 | 0.650 | 0.692 | 0.94 | Invention Example |
| Example B8 | 0.23 | 400 | 2 | 1.5 | 0.693 | 0.714 | 0.97 | Invention Example |
| Example B9 | 0.23 | 500 | 2 | 2.4 | 0.678 | 0.707 | 0.96 | Invention Example |
| Example B10 | 0.23 | 600 | 2 | 7.8 | 0.843 | 0.788 | 1.07 | Comparative Example |
| Example B11 | 0.23 | 700 | 1 | 8.2 | 0.923 | 0.824 | 1.12 | Comparative Example |

TABLE 1-continued

| | Sheet thickness (mm) | Steel sheet temperature during working (° C.) | Number of twin (count/mm) | Amount of eluted phosphorus (mg/m$^2$) | Core loss $W_A$ of steel sheet (W/kg) | Core loss $W_B$ of steel sheet (W/kg) | BF [$W_A/W_B$] | Classification |
|---|---|---|---|---|---|---|---|---|
| Example B12 | 0.23 | 800 | 1 | 7.5 | 0.957 | 0.839 | 1.14 | Comparative Example |
| Example B13 | 0.23 | 900 | 2 | 11.2 | 0.940 | 0.832 | 1.13 | Comparative Example |
| Example B14 | 0.23 | 1000 | 1 | 10.4 | 0.940 | 0.832 | 1.13 | Comparative Example |

TABLE 2

| | Sheet thickness (mm) | Steel sheet temperature during working (° C.) | Number of twins (count/mm) | Amount of eluted phosphorus (mg/m$^2$) | Core loss $W_A$ of steel sheet (W/kg) | Core loss $W_B$ of steel sheet (W/kg) | BF [$W_A/W_B$] | Classification |
|---|---|---|---|---|---|---|---|---|
| Example C1 | 0.20 | 25 | 11 | 32.0 | 0.858 | 0.752 | 1.14 | Comparative Example |
| Example C2 | 0.20 | 50 | 9 | 33.0 | 0.770 | 0.713 | 1.08 | Comparative Example |
| Example C3 | 0.20 | 80 | 9 | 39.9 | 0.700 | 0.680 | 1.03 | Comparative Example |
| Example C4 | 0.20 | 100 | 6 | 25.5 | 0.660 | 0.660 | 1.00 | Comparative Example |
| Example C5 | 0.20 | 150 | 3 | 4.5 | 0.583 | 0.620 | 0.94 | Invention Example |
| Example C6 | 0.20 | 200 | 3 | 2.9 | 0.596 | 0.627 | 0.95 | Invention Example |
| Example C7 | 0.20 | 300 | 2 | 1.2 | 0.583 | 0.620 | 0.94 | Invention Example |
| Example C8 | 0.20 | 400 | 2 | 1.5 | 0.608 | 0.634 | 0.96 | Invention Example |
| Example C9 | 0.20 | 500 | 1 | 1.8 | 0.634 | 0.647 | 0.98 | Invention Example |
| Example C10 | 0.20 | 600 | 1 | 7.2 | 0.756 | 0.706 | 1.07 | Comparative Example |
| Example C11 | 0.20 | 700 | 1 | 8.2 | 0.828 | 0.739 | 1.12 | Comparative Example |
| Example C12 | 0.20 | 800 | 1 | 7.5 | 0.858 | 0.752 | 1.14 | Comparative Example |
| Example C13 | 0.20 | 900 | 2 | 11.2 | 0.843 | 0.746 | 1.13 | Comparative Example |
| Example C14 | 0.20 | 1000 | 1 | 10.4 | 0.843 | 0.746 | 1.13 | Comparative Example |
| Example D1 | 0.18 | 25 | 11 | 9.7 | 0.765 | 0.683 | 1.12 | Comparative Example |
| Example D2 | 0.18 | 50 | 9 | 9.5 | 0.685 | 0.647 | 1.06 | Comparative Example |
| Example D3 | 0.18 | 80 | 9 | 10.4 | 0.647 | 0.628 | 1.03 | Comparative Example |
| Example D4 | 0.18 | 100 | 6 | 6.6 | 0.610 | 0.610 | 1.00 | Comparative Example |
| Example D5 | 0.18 | 150 | 2 | 3.3 | 0.539 | 0.573 | 0.94 | Invention Example |
| Example D6 | 0.18 | 200 | 3 | 2.9 | 0.551 | 0.580 | 0.95 | Invention Example |
| Example D7 | 0.18 | 300 | 3 | 1.2 | 0.539 | 0.573 | 0.94 | Invention Example |
| Example D8 | 0.18 | 400 | 1 | 1.5 | 0.574 | 0.592 | 0.97 | Invention Example |
| Example D9 | 0.18 | 500 | 1 | 1.8 | 0.562 | 0.586 | 0.96 | Invention Example |
| Example D10 | 0.18 | 600 | 2 | 7.2 | 0.698 | 0.653 | 1.07 | Comparative Example |
| Example D11 | 0.18 | 700 | 1 | 8.2 | 0.765 | 0.683 | 1.12 | Comparative Example |
| Example D12 | 0.18 | 800 | 1 | 7.5 | 0.793 | 0.695 | 1.14 | Comparative Example |
| Example D13 | 0.18 | 900 | 2 | 11.2 | 0.779 | 0.689 | 1.13 | Comparative Example |
| Example D14 | 0.18 | 1000 | 1 | 10.4 | 0.779 | 0.689 | 1.13 | Comparative Example |

[Conclusions of Results]

It was confirmed that by setting the temperature of the corner portion forming region during bending to 150° C. or higher, the number of deformation twins per unit length can be suppressed to five or less. As the temperature of the corner portion forming region during bending increases, the number of deformation twins can be suppressed. However, when the temperature of the corner portion forming region during bending reaches 600° C. or higher, the amount of phosphorus eluted from the corner portion increases, and thus the BF value also increases. From the result, it is inferred that in a case where the temperature of the corner portion forming region during bending is 600° C. or higher, cracking occurs in the coating containing phosphorus in the bent region, and stacking between the steel sheets occurs.

In the invention example in which the temperature of the corner portion forming region during bending is controlled to 150° C. to 500° C., in a side view, the number of deformation twins present in the bent region is five or less per 1 mm of the length of the center line in the sheet thickness direction in the bent region, and the amount of phosphorus eluted from the corner portion in a case of being boiled in water for 30 minutes becomes 6.0 mg or less per 1 m$^2$ of the surface area of the corner portion, so that it became obvious that as the wound core, a wound core which is low in core loss value and BF value and has suppressed core loss while having a bent region is obtained.

INDUSTRIAL APPLICABILITY

According to the present invention, it is possible to provide a wound core with suppressed core loss while having a bent region, and a manufacturing method thereof.

BRIEF DESCRIPTION OF THE REFERENCE SYMBOLS

1, 1*a*: grain-oriented electrical steel sheet
2: laminate
3: corner portion
4, 4*a*, 4*b*: flat portion
5, 5*a*, 5*b*, 5*c*: bent region
6: joint portion
7: deformation twins

10: wound core
21: grain-oriented electrical steel sheet
22: die
23: guide
24: punch
25: conveyance direction
26: pressing direction

What is claimed is:

1. A wound core formed by laminating a plurality of bent bodies formed from a grain-oriented electrical steel sheet having a coating containing phosphorus formed on a surface, in a sheet thickness direction of the grain-oriented electrical steel sheet, wherein the bent body is formed in a rectangular shape by having four flat portions and four corner portions adjacent to the flat portions, the corner portion has a bent region having a total bending angle of approximately 90° in a side view, the number of deformation twins present in the bent region in the side view is five or less per 1 mm of a length of a center line in the bent region in the sheet thickness direction, and the amount of phosphorus eluted from the corner portion in a case of being boiled in water for 30 minutes is 6.0 mg or less per 1 $m^2$ of a surface area of the corner portion.

2. The wound core according to claim 1, wherein the grain-oriented electrical steel sheet is a steel sheet in which local strain is applied to a surface of the steel sheet, or a steel sheet in which a groove is formed in a surface of the steel sheet.

3. The wound core according to claim 1, wherein a Si content of the grain-oriented electrical steel sheet is 2.0 to 5.0 mass %.

4. The wound core according to claim 1, wherein the bent region is a region enclosed by, in a side view of the bent body, when a point D and a point E on a line La representing an inner surface of the bent body and a point F and a point G on a line Lb representing an outer surface of the bent body are defined as follows, a line delimited by the point D and the point E on the line La representing the inner surface of the bent body, a line delimited by the point F and the point G on the line Lb representing the outer surface of the bent body, a straight line connecting the point D and the point G, and a straight line connecting the point E and the point F, in the side view, a point at which a straight line AB connecting a center point A of a radius of curvature of a curved portion included in the line La representing the inner surface of the bent body to a point of intersection B between two imaginary lines Lb-elongation1 and Lb-elongation2 obtained by extending straight-line portions respectively adjacent to both sides of a curved portion included in the line Lb representing the outer surface of the bent body intersects the line representing the inner surface of the bent body is referred to as an origin C, a point separated from the origin C by a distance m represented by Equation (1) in one direction along the line La representing the inner surface of the bent body is referred to as the point D, a point separated from the origin C by the distance m in the other direction along the line La representing the inner surface of the bent body is referred to as the point E, a point of intersection between a straight-line portion opposing the point D in the straight-line portion included in the line Lb representing the outer surface of the bent body and an imaginary line drawn perpendicularly to the straight-line portion opposing the point D through the point D is referred to as the point G, and a point of intersection between a straight-line portion opposing the point E in the straight-line portion included in the line Lb representing the outer surface of the bent body and an imaginary line drawn perpendicularly to the straight-line portion opposing the point E through the point E is referred to as the point F, $$m = r \times (\pi/4) \qquad \text{Equation (1):}$$

where m represents a distance from the origin C, and r represents a distance (radius of curvature) from the center point A to the origin C.

5. A manufacturing method of the wound core according to claim 1, comprising:

preparing a plurality of grain-oriented electrical steel sheets having a coating containing phosphorus on a surface;

forming a plurality of bent bodies having a substantially rectangular shape in a side view by bending each corner portion forming region previously allocated to the plurality of grain-oriented electrical steel sheets in a state in which a temperature of the corner portion forming region is set to 150° C. or higher and 500° C. or lower; and laminating the plurality of bent bodies in a sheet thickness direction.

* * * * *